United States Patent [19]

Williams

[11] Patent Number: 5,060,603

[45] Date of Patent: Oct. 29, 1991

[54] INTERNAL COMBUSTION ENGINE CRANKDISC AND METHOD OF MAKING SAME

[76] Inventor: Kenneth A. Williams, 315 Eastleigh Dr., Belleair, Fla. 34616

[21] Appl. No.: 464,326

[22] Filed: Jan. 12, 1990

[51] Int. Cl.[5] ..... F02B 75/32

[52] U.S. Cl. ..... 123/58 A; 123/197 AC

[58] Field of Search ..... 123/78 BA, 78 E, 78 F, 123/48 B, 197 R, 197 AC, 58 A

[56] References Cited

U.S. PATENT DOCUMENTS

| | | | |
|---|---|---|---|
| 1,783,589 | 12/1930 | Shepard | 123/78 F |
| 1,978,058 | 10/1934 | Peterson . | |
| 2,151,853 | 3/1939 | Jonville et al. | 123/78 BA |
| 2,340,010 | 1/1944 | Miller | 123/78 F |
| 4,044,629 | 8/1977 | Clarke | 123/78 BA |
| 4,152,955 | 5/1979 | McWhorter | 123/78 E |
| 4,211,190 | 7/1980 | Indech | 123/78 F |
| 4,437,438 | 3/1984 | Mederer | 123/78 E |
| 4,466,403 | 8/1984 | Menton | 123/197 AC |
| 4,467,756 | 8/1984 | McWhorter | 123/197 AC |
| 4,712,518 | 12/1987 | Johnson | 123/48 B |
| 4,803,964 | 2/1989 | Kurek et al. | 123/197 AC |

FOREIGN PATENT DOCUMENTS

| | | | |
|---|---|---|---|
| 2445435 | 8/1980 | France | 123/78 F |

*Primary Examiner*—David A. Okonsky

*Attorney, Agent, or Firm*—Sixbey, Friedman, Leedom & Ferguson

[57] ABSTRACT

A mechanism and method for increasing an internal combustion engine's output efficiency by improving the conversion of energy from a reciprocating piston motion to rotary output shaft motion by more closely matching the potential source work available from the reciprocating piston to the receiving work ability of the rotary shaft. An improved engine output shaft or output shaft design and the method of making same includes a work receiving guide on the output shaft that controls the transference of potential work to a substantially constant transitional work output. More specifically, an engine output shaft includes at least one disc-like element rotatably fixed thereto with a work receiving guide groove defined therein which engages with a lower end of a connecting rod pivotally extending from the reciprocating piston. During the power stroke, the work receiving guide means increases the length of the leverage arm and decreases the degree of angular movement associated with increments of equal displacement volume of the piston as the combustion force acting on the reciprocating piston decreases.

17 Claims, 5 Drawing Sheets

T.D.C.

60°

120°

FIG. 4

6 CYLINDER I.C. ENGINE W/3" STROKE

| INCREMENT | AVERAGE PRESSURE | LEVERAGE RATIO | AVAILABLE WORK VALUES | SHAFT ROTATION ° |
|---|---|---|---|---|
| a | 582.5 | .38 | 218.4 | 33 |
| b | 417.5 | .57 | 156.6 | 24 |
| c | 319.5 | .71 | 119.8 | 18 |
| d | 240.5 | .98 | 90.2 | 14 |
| e | 183.5 | 1.24 | 68.8 | 10 |
| f | 140.5 | 1.70 | 52.7 | 8 |
| g | 117.0 | 2.09 | 43.9 | 7 |
| h | 103.0 | 2.44 | 38.6 | 6 |

T.D.C.

60°

120°

INTERNAL COMBUSTION ENGINE CRANKDISC AND METHOD OF MAKING SAME

TECHNICAL FIELD

This invention relates to internal combustion engines and the manner of translating reciprocal motion into rotary motion with improved efficiency. More specifically, this invention is directed to an improved cam-type crankdisc that more closely matches the source work potential of a reciprocating piston to the receiving work ability of the engine output shaft.

BACKGROUND OF THE INVENTION

Internal combustion engine design has been subject to constant modifications and redesigns since its inception with the specific purpose of improving engine operating efficiency. Many improvements, however, that are directed toward improving engine efficiency are often not practical or are so costly that no real savings can be appreciated.

One particular line of internal combustion engine modifications for increasing engine output efficiency involves the alteration of the traditional four-stroke cycle. A typical four-stroke engine cycle is defined as including an intake stroke, a compression stroke, a power stroke, and an exhaust stroke. For its operation, at least one reciprocating piston is moved within a cylinder bore from a top dead center position (hereinafter abbreviated TDC) to a bottom dead center position (hereinafter abbreviated BDC), with four strokes occurring over two revolutions of the engine output shaft. Typically, in a first revolution the piston will move inwardly from the TDC to BDC positions, defining the intake stroke during which an intake valve is opened so that an air/fuel mixture is suctioned into the engine cylinder above the piston. Thereafter, a compression stroke takes place as the piston moves outwardly so as to reduce the volume of the air/fuel mixture and increase the pressure within the engine cylinder prior to combustion of the explosive mixture. Normally, just before the beginning of the second revolution, the air fuel mixture is ignited at a point near the TDC position after which the power expansion stroke results causing the inward travel of the piston. Thereafter, the exhaust stroke occurs while the piston moves outwardly, as a result of which the exhaust gases are pumped through an exhaust valve that is opened in synchronization to the engine output shaft.

A conventional internal combustion engine includes a connecting rod pivotally connected via a wrist pin at one end to the piston and at another end to an offset portion of the output shaft for translating the reciprocal piston motion to the output shaft. The offset portion is spaced from the axis of rotation of the output shaft. The degree of offset defines the amount of leverage or the magnitude of the force moment acting on the output shaft since the leverage or moment is a function of the applied force as well as the distance between the applied force and the axis of rotation. During the power expansion stroke of the four-stroke cycle, chemical energy from the combustion of the air/fuel mixture is converted to linear motion of the piston caused by the expansion of the combusted gases. This energy is utilized to turn the engine output shaft and is released within each cylinder once during each two revolutions of the engine output shaft. Thus, it can be seen that the provision of multiple engine cylinders increases the number of times that an engine output shaft is powerfully driven during each revolution.

This conversion of chemical energy to transitional work of the piston is of course another area in which gains in efficiency have been advanced. Moreover, in modern engines, advances have also been made regarding the preparation of the air/fuel mixture by way of improved carburetors, fuel injection systems, and superchargers.

However, even in light of the recent developments regarding fuel conversion to energy and fuel consumption efficiency, modern engines still run inefficiently with regard to the ability of the engine to actually convert the energy released by combustion into actual work output from the engine. To improve this, it is necessary to improve the manner in which the potential work available from the reciprocating piston is translated to the engine output shaft or output shaft. In other words, the work provided by the piston must more closely reflect the ability of the engine output shaft to receive work.

When considering the forces that coact within the engine cylinder between the piston and the output shaft during the power expansion stroke, it will be appreciated that the pressure/force magnitude constantly decreases. The leverage arm, defined as the distance between the point of connection of the connecting rod to the output shaft and the axis of rotation of the output shaft, increases as the piston moves from the TDC position to a position 90 degrees after TDC, after which it decreases. Neither the force applied to the piston from combustion nor the leverage arm decrease or increase linearly.

Since work is dependent on the path of the product of distance times the force applied thereto, the reciprocating movement of the piston as driven during the power stroke becomes the potential work that is available to drive the output shaft. However, this potential work is limited to and by an equal albeit opposite work path of the body receiving the work, that is the output shaft, with regard to the ability of the receiving body to actually accept the potential work. The transfer of work from the piston to the output shaft becomes the transitional work. Only when the work path of the body supplying the work, the piston, is identical in force and displacement to the body receiving the work, the output shaft, will all of the potential work be transferred. When a difference exists in a work path of either component, only work of a quantity represented by the lesser path will be transferred. Thus, the ability and goal of an engine to most efficiently make use of the chemical energy provided from combustion is to find a way to more completely transfer the potential work from the reciprocating piston to the rotating output shaft by providing nearly identical source and receiving work paths.

There are many known methods and paths to permit the piston to travel from T.D.C. to B.D.C. and transfer a portion of its available potential work to a rotary member or shaft. These include a conventional output shaft, a camdisk, a camdrum, and a gear chain. The common failure in each of these approaches is their inability to provide a consistent force magnitude to the rotating output shaft throughout the entire rotational arc through which an individual piston stroke acts. Rather, what these known engines have done is to deliver an erratic and inconsistent force to the rotating output shaft while applying some random magnitude of force during the rotational arc throughout which each individual piston acts. As a result, prior art devices have attempted, yet failed, to recognize and define work receiving paths for an engine output shaft that more fully take advantage of the potential work or source work supplied by the piston. An example is shown in U.S. Pat. No. 2,006,498 to Dassett, that utilizes a noncircular cam-type output shaft for transferring the work from the piston. Although this patent does inherently provide a cam profile that modifies the leverage arm acting on the output shaft, it does not attempt to match the decreasing source work potential of the reciprocating piston to the constant receiving work capability/requirement of the engine output shaft. More specifically, the device includes a cam profile which, at the start of the downward stroke of the piston during expansion, produces a rapid displacement of the piston to thereby permit a quick expansion stroke for greater mechanical efficiency and less heat production. However, because the patent does not realize that it is important to match the potential work available as the source work to the receiving work along the entire power stroke, the Dassett device falls far short of the extent to which the receiving work path can be modified to match the source work path.

Other types of prior art devices the modify the piston strokes of a four cycle internal combustion engine are disclosed in U.S. Pat. Nos. 4,467,756 to McWhorter and U.S. Pat. No. 4,466,403 to Menton. These devices include a means to modify the crank offset or leverage arm during the course of engine operation. Specifically, the crank arm is effectively lengthened before the power expansion stroke for providing an increased leverage to produce greater torque by increasing the mechanical advantage during the power stroke. Although these devices increase engine output torque and may improve engine efficiency to at least some degree, they do not modify the crank offset during the power stroke nor do they attempt to design a work receiving output shaft specifically matched with potential work of a reciprocating piston.

Many other types of cam-driven output shaft internal combustion engines are known in the prior art including those with specifically designed cam paths that are altered to provide variable stroke mechanisms. That is to say, certain of the strokes of the typical four-cycle are modified to change the length of stroke and/or timing. An example is shown by the U.S. Pat. No. 1,728,363 to Rightenour, which discloses a double cam device for providing two reciprocating piston motions during a single output shaft rotation, wherein the cam profiles are modified specifically for varying piston speed during certain stroke instances and defining different stroke lengths depending on the stroke. Moreover, Rightenour recognizes that using a rapid movement cam profile during the firing stroke provides a modified leverage at a specific point. Again, the cam path is not tailored to match the source work with the receiving work as above described for maximizing engine operating efficiency in the translation of reciprocal motion to rotary motion.

The devices disclosed in the following U.S. Pat. Nos. 3,895,614 to Bailey, U.S. Pat. No. 3,687,117 to Panariti, U.S. Pat. No. 1,209,708 to Houlehan, U.S. Pat. No. 879,289 to Mayo et.al., U.S. Pat. No. 1,748,443 to Dawson, and U.S. Pat. No. 2,528,386 to Napper are of interest for their disclosure of engine output cam shafts which include guide tracks defined on a disc-like member associated with the output shaft and where the piston includes a roller or pin-type mechanism that is guided within the guide tracks. The guide tracks are used to translate the reciprocating motion of the piston into rotary motion of the output shaft. These patents disclose various guide paths for translating the reciprocating to rotary motion; however, they do not attempt to increase the output efficiency by matching the source work path to the receiving work path with guide paths designed accordingly.

It is clear from the above that many attempts have been made to improve engine operating efficiency with respect to the manner of translation of reciprocating motion of a piston to the rotary motion of a crank or cam-type output shaft including the use of additional leverage providing mechanisms or cam profiles affecting piston speed. However, none of these prior art references have contemplated that it is necessary to design a guide path which will most closely associate the source work path provided from a piston with the receiving work path of an output shaft for receiving and performing actual transitional work.

SUMMARY OF THE INVENTION

It is thus a primary object of the present invention to overcome the above noted shortcomings and deficiencies of the prior art mechanisms.

It is a further object of the present invention to provide an engine output shaft design that maximizes the translation of potential work from a reciprocating piston to transitional work via a rotatable engine output shaft, by providing a work exchange path that matches the available source work from the reciprocating piston with the required output work of the output shaft by controlling the point of application of the force from the reciprocating piston to the output shaft.

It is another object of the present invention to provide a mechanism for translating reciprocating motion to rotary motion on a cyclic basis in combination with an internal combustion engine, wherein the internal combustion engine includes at least one reciprocating piston slidably provided within a cylinder, a control means for synchronously supplying a combustible gas mixture to the cylinder and igniting the mixture to drive the piston inwardly during the power expansion stroke of the piston cycle, and a rotatably mounted engine output shaft which is operatively connected to the reciprocating piston by a connecting means that translates the reciprocal motion to rotary motion. The engine output shaft includes a work receiving element that changes the position of connection of the connecting means between the engine output shaft and the piston during the power stroke so as to increase the distance between the axis of rotation and the connection to the engine output shaft as the combustion force decreases. As such, a leverage arm is increased which acts to rotate the engine output shaft, thereby compensating for a constantly decreasing force acting on the reciprocating piston after combustion.

It is yet another object of the present invention to substantially match the source work available from the reciprocating piston to the required output of the engine output shaft by providing a guide groove that represents a work receiving path for defining the path of work transference so as to maximize the transfer of work to increase the efficiency of the conversion of chemical energy from combustion into usable rotary work output.

It is yet another object to decrease the heat loss during the expansion power stroke of the four-stroke cycle of an internal combustion engine by significantly improving the efficiency of energy actually translated into work output while reducing losses to heat. The overall engine efficiency is based on the actual work output divided by the potential work available. The present invention attempts to more closely approach the optimum efficiency by substantially matching the potential work to the work output.

It is still yet another object to provide an engine output shaft with an element having a guide path designed in accordance with the present invention to provide a substantially constant work output from the source work of a plurality of reciprocating pistons. It is an object to provide a uniform work output from the engine output shaft even through the engine output shaft is driven by intermittent pulses of energy from the reciprocating pistons. In this way, the work from. the reciprocating pistons is transferred over a work receiving path that more evenly receives the potential work over the entire power stroke. This is accomplished even though the piston itself is provided with a force/pressure that decreases in magnitude during the power expansion stroke.

It is yet another object of the present invention to provide a method for making an engine output shaft for use in an internal combustion engine in combination with a reciprocating piston so as to convert reciprocating motion into rotary motion while substantially matching the potential work available from the reciprocating piston during a power stroke thereof to the work receiving ability of the engine output shaft for providing a substantially constant work output.

It is still another object to provide a method for making an engine output shaft for use in an internal combustion engine including the step of designing a means fixed to rotate with the engine output shaft for determining the point of application of the force from the reciprocating piston to the engine output shaft and controlling the degree of angular rotation of the engine output shaft during the power stroke. This is achieved by determining a leverage arm, which is the distance between an axis of rotation of the engine output shaft and a point of application of the force from the reciprocating piston, for a plurality of equal displacement volume increments of the reciprocating piston displacement for the power stroke. At the same time, the degree of angular movement of the engine output shaft for each equal displacement volume increment is determined corresponding to the potential work available for each increment and the total amount of angular movement over which the power stroke is to be applied.

The above noted objects of the present invention and others not specifically referred to, but readily apparent to those skilled in the art, may be accomplished by providing an internal combustion engine including at least one piston reciprocably mounted within an internal combustion engine cylinder, a synchronous control means which supplies and controls the ignition of combustible gas to the cylinder for causing the power expansion stroke of the piston cycle, and an engine output shaft rotatably mounted within the internal combustion engine having work receiving means for guiding the transference of potential work into a substantially constant work output from the engine output shaft. More specifically, the engine output shaft includes at least one disc-like element rotatably fixed thereto with a guide groove defined therein for engaging with a lower end of a connecting rod pivotally extending from the reciprocating piston, wherein the work receiving means changes the position of the connection of the connecting rod to the disc-like element during the power stroke. Furthermore, the portion of the guide groove which is engaged during the power stroke is configured to take into account the leverage arm and degree of angular movement associated with increments of equal displacement volume of the piston along the power stroke. The leverage arm and degree of angular movement are calculated based on the known pressure and volume conditions for a specific operating piston. As a result, the guide groove optimizes the application of force from the piston to rotate the output shaft by increasing the leverage arm during the power stroke and decreasing the degree of angular rotation for each increment while the combustion force acting on the piston decreases.

In a broader sense, the present invention provides a mechanism which is operatively associated with each of two co-acting source and output work bodies to facilitate and make more efficient the transference of potential work to output work by providing a work exchange path that alters a work component, i.e., force and/or distance, of at least one of the bodies to more nearly, preferably substantially, match the available source work with the required output work. The work exchange path is determined by (1) determining the total distance component for each co-acting body, 2) determining the total work effect for each co-acting body available for exchange over the total distance, (3) dividing the total distance component for each body into a plurality of distance increments and determining the work effect for each distance increments, (4) determining the average work effect per increment by dividing the total work effect by the number of increments; and (5) determining for each distance increment a leverage point (in terms of distance and direction) for the application of a force component by one body to the other which alters, by multiplying or fractionalizing, the effect of the force component upon the other body to more nearly match the work products, i.e., force times distance, of the bodies for each increment. The leverage point for each increment corresponds to the ratio of the average work effect per increment to the work effect for each increment.

For a more complete understanding of the invention, reference is made to the following detailed description taken in conjunction with the accompanying drawings for which a preferred embodiment is described.

BRIEF DESCRIPTION OF THE DRAWING

FIG. 4 is a table setting forth an example, including the specific values of leverage arm distances and angular degrees of rotation, for designing a work receiving path for a power stroke in accordance with the present invention;

DETAILED DESCRIPTION OF THE PREFERRED EMBODIMENT

Figure 1:
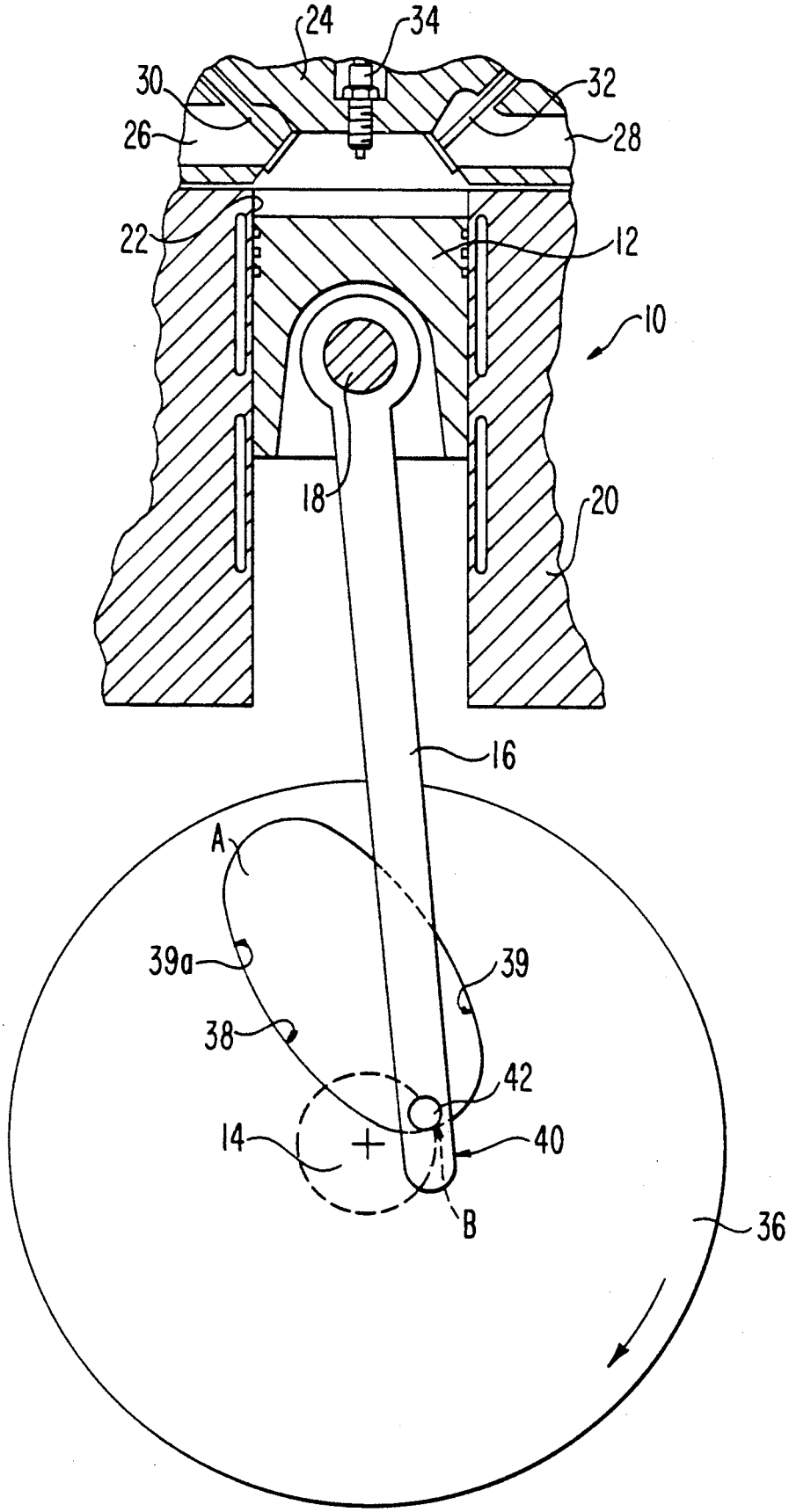
FIG. 1 is a schematic illustration of an internal combustion engine designed in accordance with the present invention showing a single engine cylinder and associated mechanism for translating reciprocal to rotary motion.

Referring now to the figures, wherein like reference numerals designate like or corresponding parts throughout the figures, and in particular to FIG. 1, an internal combustion engine 10 is shown including a reciprocating piston 12 and an engine output shaft 14 (functioning in a manner analogous to a conventional crankshaft). The reciprocating piston 12 is operatively connected with the output shaft 14 by way of a connecting rod 16 that is pivotally mounted to the piston 12 by a wrist pin 18.

The internal combustion engine 10 is basically comprised of an engine block 20 within which is defined a cylinder 22 within which the piston 12 reciprocates. It is understood that an internal combustion engine is normally comprised of a plurality of such engine cylinders 22, typically with 4, 6, or 8 cylinders. It is further understood that each cylinder is associated with its own reciprocating piston, and each reciprocating piston is operatively and drivingly associated with the output shaft 14 at each cylinder. The remaining description is directed to a single cylinder and the operation thereof with the understanding that the same principles apply to each of the cylinders of the internal combustion engine.

Above the engine block 20 is the engine head assembly 24, only partially shown, that includes an intake passageway 26 and an exhaust passageway 28. The passageways 26 and 28 are opened and closed respectively by an intake valve 20 and an exhaust valve 32 that are synchronously controlled from a cam haft (not shown) that is operatively driven from an engine output shaft in a well-known and conventional manner. A spark plug 34 is also provided within the head 24 for igniting the combustible air/fuel mixture collected within the engine cylinder at the appropriate time as controlled by the engine's electrical distributor system (not shown). The combustible air/fuel mixture utilized by an internal combustion engine designed in accordance with the present invention can be provided by a conventional carburetor system or may include fuel injection systems with or without supercharging.

The present invention is directed to a unique means for converting reciprocating piston movement to rotary motion for increasing the efficiency of transferred work, as applied to a basic internal combustion engine. The basic four-stroke cycle includes an intake stroke, a compression stroke, a power expansion stroke, and an exhaust stroke. These strokes take place as the reciprocating piston 12 moves from its top dead center position (hereinafter TDC) to its bottom dead center position (hereinafter BDC). More specifically, the intake stroke takes place during movement from an initial TDC position to a BDC position while the intake valve 30, as synchronously controlled from an engine output shaft, is opened so that a combustible air/fuel mixture is sucked into the cylinder 22 above the reciprocating piston 12. Subsequently, the output shaft 14, by rotation thereof, will force the piston 12 from the BDC position to the TDC position while the intake and exhaust valves 30 and 32 are maintained closed, and the combustible air/fuel mixture is compressed. Then, ignition is provided by the spark plug 34 to explode and expand the hot gases and as a result to downwardly drive the piston 12 toward the output shaft 14 from the TDC position to the BDC position. This is the power expansion stroke. Finally, to complete the cycle, the output shaft 14 once again drives piston 12 upwardly from the BDC position to the TDC position while, this time, the exhaust valve 32 is opened to evacuate the burned gases. As can be seen, the four strokes take place over two revolutions of the output shaft 14 with each revolution defining a single inward and outward stroke.

The present invention is specifically directed to a means and a method for designing such means for converting the reciprocating motion of a piston to rotary motion of an engine output shaft that will accommodate the power expansion stroke, as above described, so as to more efficiently transmit to the rotary output shaft the work resultant from the force/pressure applied to the piston 12 by the combustion of the compressed air/fuel mixture.

Figure 5:
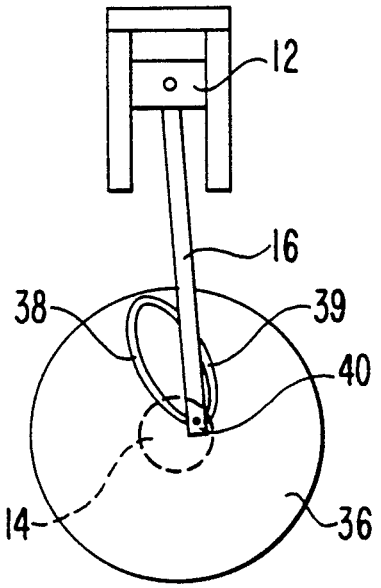
FIG. 5 is a schematic view of an engine cylinder including an engine output shaft provided with a work receiving path determined in accordance with the present invention showing the piston and output shaft at the top dead center position.
Figure 6:
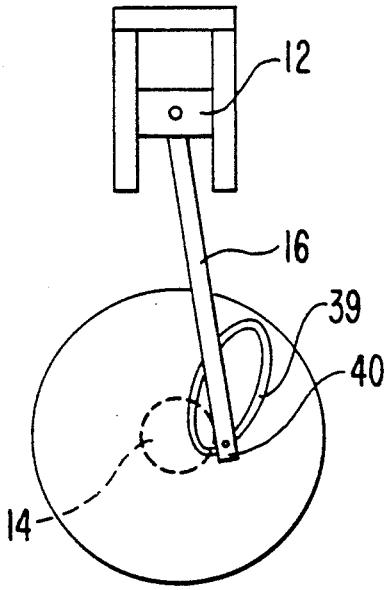
FIG. 6 is a schematic view similar to FIG. 5 showing the piston and engine output shaft positions at 60 degrees after top dead center.
Figure 7:
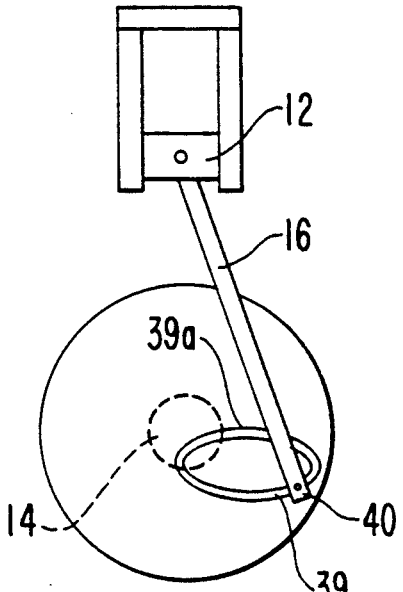
FIG. 7 is a schematic view similar to FIGS. 5 and 6 showing the piston and engine output shaft in positions corresponding to 120 degrees after top dead center.

The output shaft 14, designed in accordance with the present invention, includes a disc-like element 36 that is fixed with or operatively connected to the output shaft 14 just below each engine cylinder 22. It is understood that the disc-like element 36 can be directly fixed to the engine output shaft or, generally for multi-cylinder engines, can be fixed to an intermediate support that transfers the rotary motion and output work to a further output shaft by way of a transfer means such as a chain, belt, or gearing. The disc-like element 36 is provided with a guide groove 38 that determines the path of travel of the end 40 of the connecting rod 16. It will the appreciated that although denominated a groove, in fact element 38 may be an opening provided in disc-like element 36, the periphery of which performs the guiding function as in FIG. 1. Alternatively, it may be a groove, such as is shown in FIGS. 5–7, the inner and outer peripheral limits of which are specifically defined.

The guide groove 38, specifically the portion of the groove 39 located clockwise between A and B (shown in FIG. 1), defines the work receiving path that must receive the work transferred from the reciprocating piston 12 during the power expansion stroke. To facilitate movement of the end 40 of connecting rod 16 within the guide groove 38 a pin or roller element 42 is preferably mounted to the end 40 to extend perpendicular to the direction of elongation of the connecting rod 16 and to engage in the guide groove 38. As viewed in FIG. 1, the pin or roller element 42 would extend directly into the page.

The guide groove 38 provides the means by which the reciprocating motion of the piston 12 is translated into rotary motion of the output shaft 14. Although, the use of guide grooves in general is previously known in the art, the present invention is directed to a specifically designed guide groove which permits a more efficient transfer of work from the piston 12 to the output shaft 14 while translating the reciprocating motion into rotary motion. In this regard, attention is directed to the discussion presented hereinbefore regarding the disadvantages and inefficiencies associated with known guide grooves, cams and variable crank mechanisms. In accordance with the present invention, it is a specific purpose thereof to advantageously match the potential work of the reciprocating piston 12 that occurs during the power expansion stroke to the ability of the output shaft 14 to receive the work. This matching is achieved by providing a work exchange path that most nearly fully translates the potential work of the reciprocating piston 12 into transitional work that comprises the output from the engine to the output shaft. It has been found that the ability to match the source work to the receiving work based upon both the path of the source work and that of the receiving work greatly improves the efficiency of the translation of work. In other words, the engine operating efficiency, which equals the actual work output from the engine divided by the potential work available, advantageously approaches the optimum. Moreover, the translation of work is based on the leverage arm defined by points along the portion 39 of the path formed by the guide groove 38 during the power expansion stroke and the angular degree of output shaft rotation that should take place during each increment of volume displacement of the piston. The determination of the optimum leverage arm is the basis for the design of the guide groove 38 in accordance with the present invention, as is more fully discussed hereinafter.

When determining the power stroke portion 39 of the path of the guide groove 38, it is important to take into account the fact that the source work available from the piston displacement and movement from TDC to BDC is continually decreasing while at the same time the work demand of the receiving work remains substantially constant. Moreover, the leverage arm associated with rotation of the output shaft corresponding to the piston movement from TDC to BDC progressively increases during the portion of the power stroke after TDC. For most practical purposes, this interval constitutes the effective power stroke. Thus, it is desirable to equalize the decreasing pressure force with the increasing leverage arm to provide a substantially constant torque during the power expansion stroke so as to produce a more constant engine output.

Figure 2:
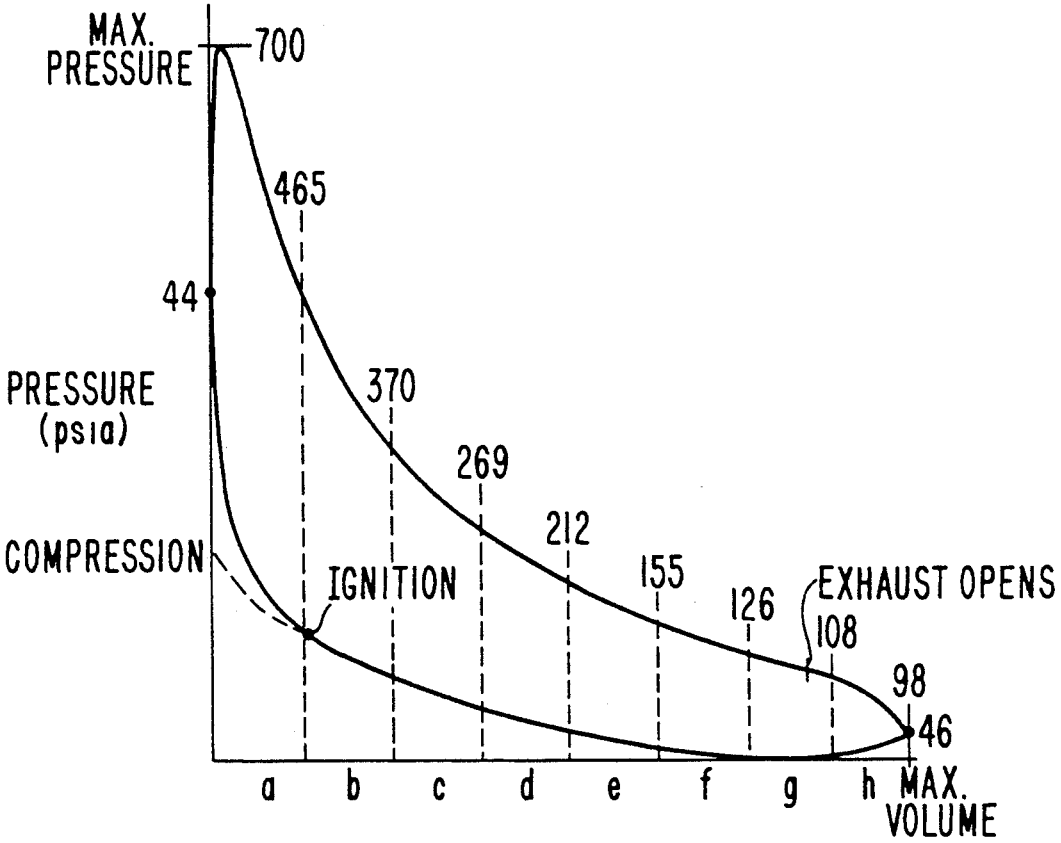
FIG. 2 is a graphic diagram comparing cylinder pressure to cylinder volume for a typical single cylinder of an internal combustion engine through the course of operation of a piston during its complete power stroke.

Referring now to FIG. 2, a pressure-volume diagram is provided reflecting the cylinder pressure as compared to the cylinder volume during the compression and power stroke of a conventional internal combustion engine. Specifically, the graph of FIG. 2 shows an engine with a 9:1 compression ratio (it being understood that other compression ratios are likewise operative in connection with the present invention). The power expansion stroke takes place between the points labeled 44 and 46 during which time the pressure continually decreases after an initial rise while the piston moves inwardly and the cylinder volume increases. The area under the curve connecting points 44 and 46 reflects the source work or potential work that is available from the reciprocating piston which is desirable to be completely translated to transitional work via the output shaft 14. Thus, the design of the guide groove 38, formed in accordance with the present invention, must effectively receive the source work according to the path represented by the guide groove 38 by designing the work receiving path for that specific purpose.

The first step in determining the path of guide groove 38 is to compute the source work available for each of several increments of the volume displaced during the power expansion stroke. The number of increments is chosen based on the ability to compute the area under the curve as a way of approximating the area represented by the integration of the curve between points 44 and 46, it being apparent that the greater the number of increments the closer the approximation. For the purposes of providing a specific example, the path is divided into eight equal increments of volume displacement with the understanding that greater or fewer increments can be used. The eight separate increments add up to the full volume, that is the total displacement of the piston during a full power expansion stroke.

The next step is to determine the number of source work power strokes that will be imparted to the output shaft so as to provide a substantially constant power application per revolution of the output shaft. This depends upon the number of engine cylinders. When a four cylinder, four cycle engine is contemplated, there are two power strokes for each revolution. When a six cylinder four cycle engine is contemplated, there are three power strokes applied during each output shaft revolution. When an eight cylinder, four cycle engine is to be designed, there are four power strokes per output shaft revolution. Furthermore, each power stroke is effectively applied over a certain angular portion of an output shaft revolution which is equal to 360 degrees divided by the number of power strokes applied per output shaft revolution, i.e., 180 degrees in the case of a four cylinder engine, 120 degrees in the case of a six cylinder engine, and 90 degrees in the case of an eight cylinder engine.

In furtherance of the first step, it is necessary to find the average pressure (force) during each volume increment and to then find the average force applied by the piston over the entire volume displacement. More specifically, this entails finding the average pressure of each increment and then totaling the average pressures and dividing that by the number of increments to determine the total average pressure applied by the piston that is available to be translated to the output shaft. This total average pressure is then divided by the pressure at the beginning of each of the volume increments to find a value for each increment that corresponds to the required leverage arm or the leverage ratio of each increment starting point in order to cause the source work potential to be leveraged to a consistent force level throughout the power stroke for application to disc-like element 36. Thus, the value for each increment corresponds to the leverage ratio for each increment, respectively, Which is used for determining the distance that the combustion force must be applied from the axis of rotation of the output shaft during each equal volume increment to achieve a consistent source work based on the leverage component.

Furthermore, to find the angular degree of shaft rotation that should most efficiently take place over each successive equal volume increment of the piston stroke, it is necessary to divide the length of the piston stroke, which is a function of the engine displacement, by the number of increments to yield a number equal to piston stroke length during each increment. For the sake of example, a total piston stroke of three inches that is divided by eight increments will provide a stroke of each increment which equals 0.375 inch. Then, the average pressure of each equal volume increment is multiplied by the stroke increment 0.375 inch, to provide a value of the work available from each volume increment. Next, each of these work/increment values are added together to yield the total source work available for each power stroke. The total source work approximates the area under the curve of FIG. 2 between points 44 and 46 corresponding to the power stroke. The receiving work effect per degree of rotation can be determined by dividing the total source work by the number of degrees over which a power stroke is utilized, a value which is defined above depending on the number of engine cylinders. To determine the ideal number of degrees of receiving work shaft rotation for each of the equal stroke increments, that when added together equals the total number of degrees over which the power stroke is utilized based on the number of cylinders, each of the values of work/increment that were determined by multiplying the average pressure of each volume by the stroke length for each increment, is divided by the receiving work effect per degree of rotation (work/increment divided by work/degree equals degrees/increment).

As a result of the foregoing calculations, the leverage distance from the axis of rotation of the output shaft for each increment at which the force from the piston should be applied is determined as is the degree of angular rotation of the receiving work shaft for each successive increment of the piston stroke. From this, the work receiving path of the power stroke portion 39 of the guide groove 38 that is to be formed on the circular disc-like element 36 can be made by plotting each of the respective distances from the axis of rotation of the output shaft for each increment and the degree of angular rotation for each increment starting from the vertical line passing through the axis of rotation of the output shaft. This technique is illustrated below with a specific example wherein the values are provided in the table of FIG. 4 and the distances and degrees of angular rotation are plotted on a disc in FIG. 3 from which the path of the power stroke portion 39 of the guide groove 38 is determined.

The example of FIG. 4 is directed to the design of a power stroke portion 39 of a guide groove 38 to be provided on a disc-like element 36 associated with an engine output shaft. Specifically, the example is designed for a six cylinder internal combustion engine having a stroke length of three inches for each piston of each of the six cylinders. Only one power stroke path will be described with the understanding that each cylinder would include its own disc-like element 36 defined with a similar guide groove 38 having a similar power stroke portion 39 with the angular orientation of each disc designed with respect to one another in accordance with the engine timing system. Moreover, and in accordance with the above, three power strokes will be applied during each output shaft revolution.

The first step in finding the leverage arm for each equal volume increment, which is represented as the above-described leverage ratio, is to calculate the average pressure or force, for each volume increment. For determining the average pressure of each increment, reference is made to the PV diagram of FIG. 2, wherein the pressure values are shown for each increment at the dashed line separating the increments. For the first increment, noted "a", the average pressure equals 700 plus 465 divided by 2 which is 582.5. This value is listed in FIG. 4 in the average pressure column corresponding to increment "a". Likewise, the values for the average pressure for the remaining seven increments are calculated and listed in FIG. 4, column 2.

Next, each of the average pressures are added together to total 2104. Then, this total of the average pressures, 2104, is divided by the number of increments, which is 8, to equal the total average pressure or force applied by the piston that is available to be translated to the output shaft, a value which is calculated to be 263 psi. To continue the calculation, the total average pressure is divided by the pressure at the beginning of each of the volume increments so as to find the value that corresponds to the required leverage arm or the leverage ratio for the beginning of each increment. It will be appreciated that a functionally equivalent guide groove 38 can be obtained by dividing the total average pressure by the pressure at any point along each volume increment, provided only that the same point be utilized in each volume increment. This leverage ratio represents the distance from the axis of rotation of the engine output shaft in order to cause the source work potential to be applied by way of a leverage arm to produce a consistent force level throughout the power stroke. For increment "a" the leverage arm is 263 divided by 700 equals 0.38. The values for the leverage ratio for each increment are listed in FIG. 4, column 3. The distances from the output shaft axis of rotation of determined in the units based on the volume increment, which in the present example is in inches.

To find the angular degree of shaft rotation that should occur for each of the equal volume increments of the piston stroke, the stroke of each increment is determined to be 0.375 inch based on the three inch total piston stroke. To find the work available values for each volume increment, the average pressure listed in the second column on FIG. 4 is multiplied by the stroke increment. These work available values are listed in the fourth column as the available work for each increment. The available work is represented in work per increment. Next, each of these available work/increment values are totaled to yield the total source work available for each power stroke, which in the present example is 789. Then, the total source work is divided by the number of degrees over which a power stroke is utilized, which is 120 degrees for a six cylinder engine, to yield the receiving work effect per degree of rotation. In the example, this number calculates to be 6.58. Lastly, in order to find how many degrees of receiving work shaft rotation must occur for each successive increment of the piston stroke, each of the available work increments listed in column 4 are divided by the receiving work effect per degree of rotation calculated above. These values of the shaft rotation in degrees per increment are listed in column 5, wherein the total amount of shaft rotation sums to the 120 degrees over which the total power stroke is applied.

Figure 3:
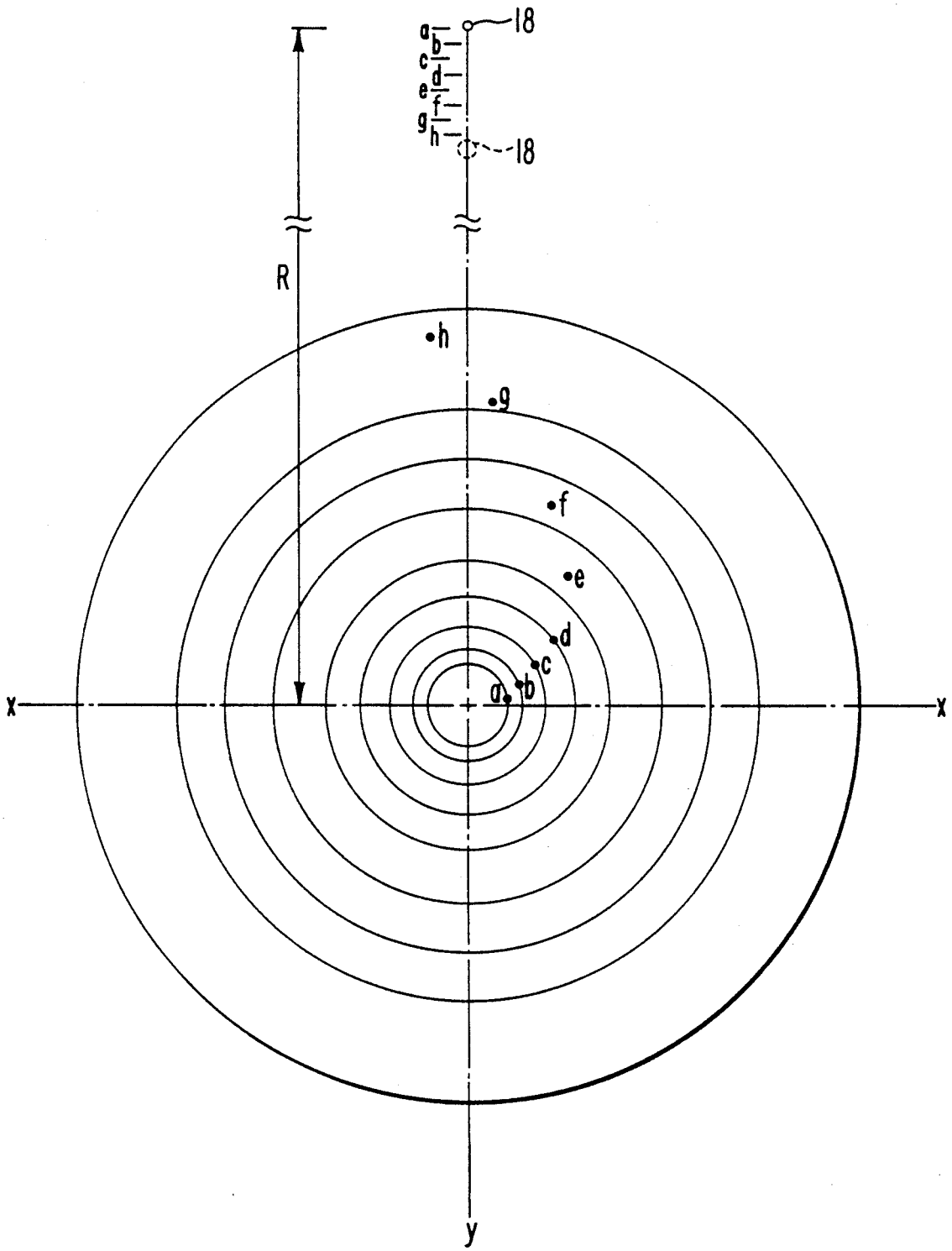
FIG. 3 is a side view of a disc-like element of the engine output shaft that is associated with one reciprocating piston, wherein details of the formation of the power stroke work receiving path are shown.

To convert the values listed in FIG. 4 to a usable work receiving path, the values may be conveniently plotted as shown in FIG. 3 by drawing a plurality of concentric circles, each having as its radius the calculated leverage ratio for each increment and having its center at the axis of rotation of the disc-like element 36. Next, the location of wrist pin 18 at TDC is determined in vertical alignment with axis Y of the concentric circles at a distance R, representing the length of connecting rod 16, from the axis of rotation, i.e., the intersection of horizontal axis X and axis Y. Inasmuch as wrist pin 18 moves vertically downwardly a distance equal to the three inch total piston stroke as piston 12 moves from TDC to BDC, the location of wrist pin 18 at BDC is determined along axis Y and is shown in phantom on FIG. 3. The stroke length between TDC and BDC is then divided into the eight equal volume increments of this example and the beginning of each increment is marked a, b, c, d, e, f, g and h, respectively.

At this stage the points corresponding to each increment which determine the desired work receiving path can be located by overlaying the plot with a transparent disc capable of rotation about an axis through the intersection of axes X and Y and marking on the disc the plurality of concentric circles illustrated in FIG. 3 and a point T corresponding to the location of wrist pin 18 at TDC. The point "a" on the plot is located by determining the location of the end of the connecting rod corresponding to a leverage arm of 0.375. This is most conveniently accomplished by providing a transparent straight edge having two spaced apart points marked thereon corresponding to wrist pin 18 (point WR) and the end of connecting rod 16 (point E) such that the distance between the points corresponds to the length of the connecting rod. By placing point WR on the straight edge at "a" to indicate the starting location of wrist pin 18 and positioning the straight edge such that it tangentially contacts the innermost concentric circle (corresponding to a leverage arm of 0.375), the position of point E indicates the end of connecting rod 16 and the location of point "a", which is marked upon the overlay as "a". To locate point "b" the overlay is rotated clockwise through the shaft rotation arc of 33 degrees for increment "a", i.e., point T is rotated clockwise 33 degrees from axis Y. The straight edge is applied to the overlay with point WR at "b" to indicate the starting location of wrist pin 18 following completion of increment "a" of the piston stroke and the straight edge is positioned such that it tangentially contacts the next concentric circle (corresponding to a leverage arm of 0.57). The position of point E on the straight edge indicates the end of connecting rod 16 at this stage and the location of point "b", which is marked upon the overlay as "b". Points "c", "d", "e", "f", "g" and "h" are located along the overlay in a similar manner. As a result the points indicated as "a" through "h" on FIG. 3 illustrate a work receiving path that when followed provides the desired leverage arm and the desired degree of angular rotation for each increment. This curve corresponds to the power stroke portion 39 of the guide groove 38 which operates as follows.

Referring now to FIGS. 5, 6 and 7, the operation of the mechanism of the present invention for transference of the reciprocal motion of a piston 12 to the rotary motion of the output shaft 14 is illustrated. In FIG. 5, the piston 12 is in its TDC position while the lower end 40 of connecting rod 16 is positioned in a lower right-hand portion of the guide groove 38 corresponding to point a of FIG. 3. Thereafter, piston 12 is forced downwardly by the combustion of the mixture in the chamber above the piston 12 while the output shaft 14 rotates clockwise by 60 degrees, as shown in FIG. 6. In this orientation, the lower end 40 of the connecting rod 16 has moved radially further from the axis of rotation of the output shaft 14 while piston 12 has moved inwardly (that is, toward the output shaft). The amount of radial movement is relatively small when compared to the amount of output shaft rotation since the pressure force acting on the piston is still relatively high. Subsequently, and as shown in FIG. 7, when the output shaft rotates by 120 degrees, the entire stroke of travel of piston 12 has taken place and the bottom end 40 of the connecting rod 16 has moved to its radial outermost position represented as location h in FIG. 3. The result is that as the piston moves downwardly with a maximum force just after combustion dwindling to a minimum force at the 120 degree output shaft position the leverage arm is increased in accordance with the specifically designed guide path portion 39 to balance the leverage arm to the decreasing force. Thus, a more closely optimal work transference can take place. Moreover, the substantially constant output required from the engine output shaft is facilitated by applying the available potential work from the reciprocating piston substantially evenly over the entire power stroke depending on the number of engine cylinders. Following the power stroke the piston moves outwardly during the exhaust stroke as the lower end 40 of the connecting rod 16 is guided by guide surfaces 39*a* of groove 38 to the TDC position shown in FIG. 5.

INDUSTRIAL APPLICABILITY

The present invention is applicable to all devices wherein reciprocal motion is used to drive a rotating output shaft, whether by direct or indirect drive. Moreover, the present invention finds specific applicability to internal combustion engines utilizing reciprocal pistons with a four-stroke cycle; however, it is contemplated that the same principles could be applied to a two-stroke cycle by taking into account the application of the power stroke to the output shaft in a similar manner. Furthermore, the present invention finds applicability to all sizes of internal combustion engines ranging from small single cylinder engines such as are used in lawn mowers and the like, up to and including large diesel engines that power large tractors, trailers, ships and stationary equipment.

In addition, it will be appreciated that the present invention is not limited to the specific embodiments illustrated and described. Thus, for example, the crank-disc of the illustrated embodiment can take other physical forms, such as a cylindrical drum, provided only that the physical form employed incorporates a guide path position as described herein to guide the movement of the connecting rod to effectively determine the point of application of the force from the reciprocating piston to the engine output shaft leverage point. Likewise, the present invention is not limited to matching a variable source work with a substantially constant required output work. Rather it is equally applicable to demand varying devices, such as a compressor, wherein the source work is substantially constant and, in accordance with the present invention, a work exchange surface is provided which varies the leverage arm and angular degree of rotation to make the varying load appear substantially constant upon the input shaft.

I claim:

1. A mechanism for translating reciprocating motion to rotary motion on a cyclic basis in combination with an internal combustion engine comprising:

at least one reciprocating piston slidably provided within a cylinder of said internal combustion engine;

synchronous control means which supplies a combustible mixture to said cylinder and ignites the mixture for producing a combustion force causing the piston to move in one direction of its reciprocating motion to provide a power stroke of the piston cycle; and an engine output shaft rotatably mounted with said internal combustion engine, connection means for operatively connecting said engine output shaft to said reciprocating piston for translating the reciprocal motion of said piston to rotary motion of said shaft through a leverage arm between the axis of rotation of said engine output shaft and the point of operative connection between said piston and said shaft, said engine output shaft including work receiving means for increasing the length of said leverage arm during said power stroke while the combustion force acting on said reciprocating piston decreases, said work receiving means including means for providing a substantially constant level of torque to said engine output shaft during the power stroke despite said decreasing combustion force acting on said piston during the power stroke.

2. The mechanism of claim 1, wherein said work receiving means includes a disc-like element fixed with said engine output shaft and a guide means on said disc-like element, said connecting means includes a connecting rod pivotally connected at a first end to said piston and an element on a second end that engages within said guide means, whereby said second end is guided by said guide means to define the movement of said second end away from the axis of rotation of said engine output shaft through said power stroke.

3. The mechanism of claim 2, wherein said power stroke comprises a plurality of incremental volume displacements of said piston caused by said combustion force, the second end of said connecting rod is guided in said guide means during said power stroke along a power stroke portion of said guide means for providing a substantially constant level of torque to said engine output shaft, said power stroke portion of said guide means defining a connecting rod guide path that is determined based on a plurality of leverage arms and angular positions corresponding to the combustion force available at said plurality of increments of volume displacement of the power stroke of said reciprocating piston.

4. The mechanism of claim 3, connecting rod guide receiving path corresponds to a curve that increases the leverage arm and decreases the degree of angular rotation of said output shaft for each of the plural increments of displacement volume during said power stroke.

5. The mechanism of claim 4, wherein the leverage arm at each of equal volume displacement increments is determined by a leverage ratio which is the ratio of the total average pressure applied by the piston to the beginning pressure at each of the displacement volume increments.

6. The mechanism of claim 5, wherein the degree of angular rotation for each of the displacement volume increments is determined based on the degree of rotation over which the power stroke is to be applied, a function of the number of cylinders in the internal combustion engine, and the work available for each equal displacement volume increment.

7. The mechanism of claim 6, wherein said internal combustion engine includes four cylinders that operate on a four-stroke cycle, two power strokes occur during each single rotation of said engine output shaft each power stroke acts on said engine output shaft over substantially 180 degrees of engine output shaft rotation.

8. The mechanism of claim 6, when said internal combustion engine includes six cylinders that operate on a four-stroke cycle, three power strokes occur during each single rotation of said engine output shaft and each power stroke acts on said engine output shaft over substantially 120 degrees of engine output shaft rotation.

9. The mechanism of claim 6, when said internal combustion engine includes eight cylinders that operate on a four-stroke cycle, four power strokes occur during each single rotation of said engine output shaft and each power stroke acts on said engine output shaft over substantially 90 degrees of engine output shaft rotation.

10. A method of making an engine output shaft for use in an internal combustion engine in combination with a reciprocating piston so as to convert reciprocating motion into rotary motion by providing a substantially constant level of torque to said engine output shaft despite a decreasing combustion force acting on said piston during the power stroke, comprising the steps of:

providing an engine output shaft;

determining a leverage arm that is equal to the distance between the axis of rotation of the engine output shaft and the point of application of the force from the reciprocating piston for a plurality of equal displacement volume increments of the piston stroke;

determining a degree of angular rotational movement of the engine output shaft for each equal displacement volume increment corresponding to the potential work available for each increment and the total amount of angular rotational movement of the engine output shaft over which the power stroke is to be applied; and providing a work receiving means fixed to rotate with said engine output shaft for guiding the point of application of the force from the reciprocating piston to the engine output shaft and controlling the degree of angular rotation of said engine output shaft during the power stroke in accordance with the determined leverage arm and degree of angular movement for each equal displacement volume increment.

11. The method of claim 10, including the step of forming said means fixed to rotate with said engine output shaft as a guide groove adapted t be engaged by a connecting rod pivotally extending from the reciprocating piston, said guide groove defining a connecting rod guide path that corresponds to the determined values of the leverage arm and angular movement for each of said equal displacement volume increments.

12. The method of claim 11, wherein said leverage arm and said degree of angular movement are determined based on the relationship between pressure and volume during the power stroke of the reciprocating piston.

13. The method of claim 12, wherein said leverage arm is determined by finding the average pressure for each equal displacement volume increment, finding the average of the average pressures for each increment, and determining said leverage arm as the ratio of the average of the average pressures to the pressure at the start of each equal displacement volume increment.

14. The method of claim 12, wherein said degree of angular movement for each equal displacement volume increment is determined by finding the potential work available for each equal displacement volume increment as the product of the average pressure for each increment and the piston stroke of each equal displaced volume increment, determining the total source work available from the sum of the potential work available for each of the equal displacement volume increments, determining the receiving work effect per degree of rotation of the engine output shaft by dividing the total source work available by the number of degrees over which the power stroke is to be applied, and determining a value for the degree of angular movement for each equal displacement volume increment by dividing the potential work for each equal displacement volume increment by the receiving work effect per degree of rotation of the engine output shaft.

15. The method of claim 14, wherein the engine output shaft is used in combination with a four cylinder, four-stroke internal combustion engine with two power strokes applied for each single engine output shaft rotation, and each power stroke acts on the engine output shaft over substantially 180 degrees of engine output shaft rotation.

16. The method of claim 14, wherein the engine output shaft is used in combination with a six cylinder, four-stroke internal combustion engine with three power strokes applied for each single engine output shaft rotation, and each power stroke acts on the engine output shaft over substantially 120 degrees of engine output shaft rotation.

17. The method of claim 14, wherein the engine output shaft is used in combination with an eight cylinder, four-stroke internal combustion engine with four power strokes applied for each single engine output shaft rotation, and each power stroke acts on the engine output shaft over substantially 90 degrees of engine output shaft rotation.

* * * * *